United States Patent [19]

Seidel et al.

[11] Patent Number: 4,998,338

[45] Date of Patent: Mar. 12, 1991

[54] METHOD AND ARRANGEMENT FOR MANUFACTURING HOT-ROLLED STEEL STRIP

[75] Inventors: Jürgen Seidel, Kreuztal; Wolfgang Rohde, Dormagen, both of Fed. Rep. of Germany

[73] Assignee: SMS Schloemann-Siemag Aktiengesellschaft, Dusseldorf, Fed. Rep. of Germany

[21] Appl. No.: 432,050

[22] Filed: Nov. 6, 1989

[30] Foreign Application Priority Data

Nov. 5, 1988 [DE] Fed. Rep. of Germany ..... 3837642

[51] Int. Cl.[5] ..... B21B 1/96; B21B 15/00

[52] U.S. Cl. ..... 29/527.6; 72/229; 72/249; 164/476; 29/33 C; 29/33 S; 29/33 Q; 29/527.7

[58] Field of Search ..... 29/33 C, 33 Q, 527.7, 29/335, 527.6; 164/476; 72/229, 231, 249, 200, 202, 203

[56] References Cited

U.S. PATENT DOCUMENTS 3,777,533 12/1973 Munchbach ..... 72/249 X
4,503,697 3/1985 Tippins et al. ..... 72/229 X
4,658,363 4/1987 Tippins et al. ..... 72/229 X
4,675,974 6/1987 Connolly ..... 29/527.7
4,688,897 10/1987 Frommann et al. ..... 29/527.7
4,782,683 11/1988 Tippins et al. ..... 72/229

FOREIGN PATENT DOCUMENTS 58-100903 6/1983 Japan ..... 29/527.7
62-38704 2/1987 Japan ..... 29/527.7

*Primary Examiner*—Carl J. Arbes
*Attorney, Agent, or Firm*—Toren, McGeady & Associates

[57] ABSTRACT

A method and an arrangement for manufacturing hot-rolled steel strip from continuously cast initial materials in continuously successive work steps, wherein the continuously cast initial material is cut after solidifying to a certain length, is heated in a soaking furnace to rolling temperature and is introduced into a finishing rolling mill train for rolling out. The continuously cast initial material is introduced after being heated to a multiple-stand, reversible finishing rolling mill train and a coilbox connected downstream to the finishing rolling mill train.

9 Claims, 1 Drawing Sheet

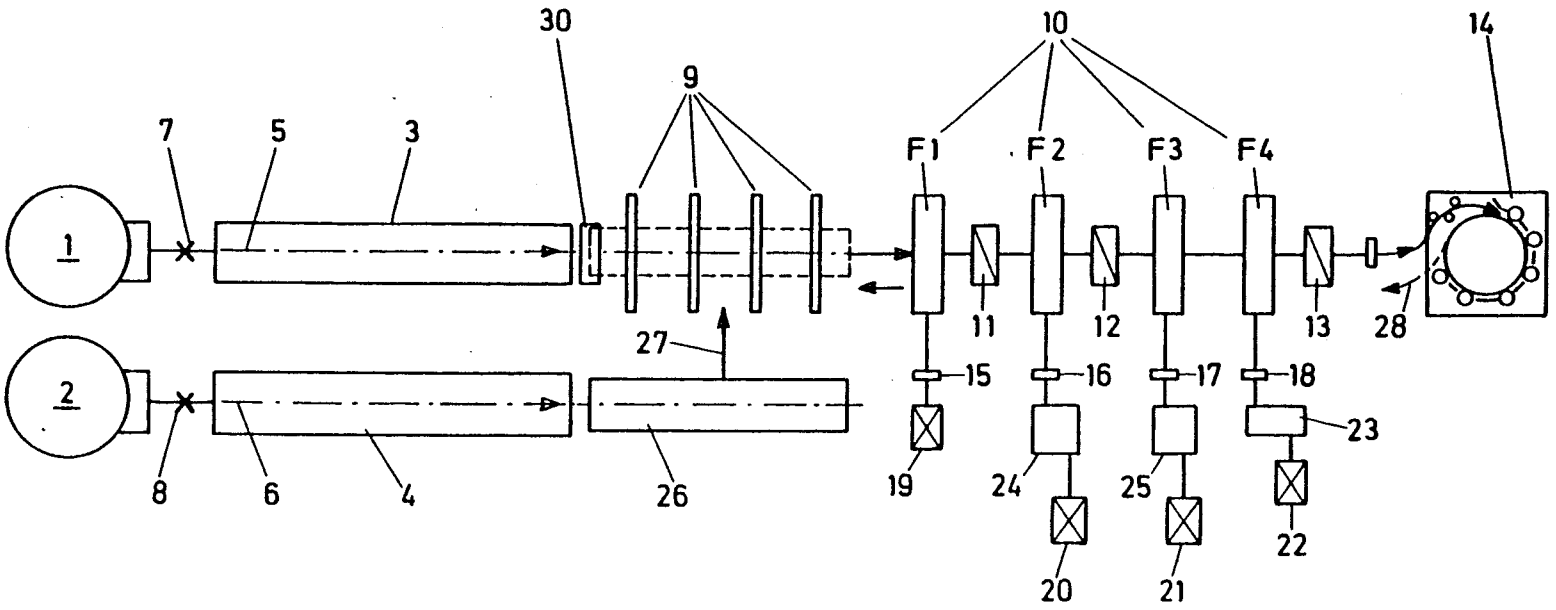
14
28
13
F4
F3
12
F2
11
F1
10
18
17
16
15
23
22
21
25
20
24
19
9
27
26
30
3
4
5
6
7
8
1
2

METHOD AND ARRANGEMENT FOR MANUFACTURING HOT-ROLLED STEEL STRIP

BACKGROUND OF THE INVENTION

1. Field of the Invention

The present invention relates to a method and an arrangement for manufacturing hot-rolled steel strip etc. from continuously cast initial materials in continuously successive work steps, wherein the continuously cast initial material is cut after solidifying to a certain length, is heated in a soaking furnace to rolling temperature and is introduced into a finishing rolling mill train for rolling out.

2. Description of the Related Art

A method for manufacturing hot-rolled steel strip is known from German Offenlegungsschrift 33 41 745. In accordance with this method, the strip-like billet arriving from the casting plant is wound into a coil and is again unwound after being heated and is introduced into a rolling mill to be rolled out to obtain the final cross-section. The casting plant includes several lines and the billets are arranged parallel in rolling direction. In addition, a furnace serving as an intermediate storage unit is arranged for receiving all billets transversely of the continuous casting plant and, thus, the furnace must have the appropriate width. The method has the disadvantage of high investment and operating costs, particularly for the furnace used for receiving the billets which are introduced parallel to each other which furnace must be of large and wide construction.

Moreover, for manufacturing hot-rolled steel strip from continuously cast initial materials, a German patent application which is not yet published provides that two strip-shaped initial material billets are heated to rolling temperature placed one above the other and together in a roller-bottom-type furnace and are individually rolled out successively in a finishing rolling mill train to obtain the finished strip. One of these billets which emerge from the roller-bottom-type furnace are introduced into a furnace which serves as an intermediate storage unit in which the strip-shaped billet is wound into a coil and is maintained hot until it is introduced into the finishing rolling mill train.

It is the primary object of the present invention to substantially improve the methods and arrangements described above, particularly the last-mentioned method for manufacturing hot-rolled steel strip, etc.

SUMMARY OF THE INVENTION

In accordance with the present invention, the continuously cast initial material is introduced after being heated into a multiple-stand, reversible finishing rolling mill train and a coilbox connected downstream to the finishing rolling mill train.

Compared to previously known and practiced methods, the present invention provides the following advantages:

Better utilization of the finishing rolling mill train.

Shorter length of the soaking furnace for heating the continuously cast initial material as well as shorter roller table lengths due to somewhat greater initial strip thickness.

The greater initial strip thickness makes possible a greater thickness of the finished strip than in thinner strips because the necessary degree of strengthening is achieved (Minimum reduction about 3:1).

The reversible finishing rolling mill train with the coilbox connected thereto is of particular advantage in connection with continuous casting technology. For example, compared to known methods, when conventional slab thicknesses (H=200 mm) are used, not only the forming moments and, thus, the number of passes are substantially reduced, but also the number of rolling mill stands is reduced (3 or 4 stands), and the stands may be of smaller construction.

Higher rolling speeds and, thus, lower thermal loads acting on the rolls and less wear of the rolls.

Higher strip speeds and, thus, shorter conveying times between the rolling mills stand reduce secondary scaling and, thus, improve the quality of the rolled product.

It is no longer necessary to use a winding furnace as an intermediate storage unit in which, in the past, the strip-shaped billet was wound into a coil and maintained hot, because the intermediate thickness of the strip-shaped rolled billet according to the method of the invention can still be coiled or wound with, for example, H=10–18 mm.

In accordance with an advantageous further development of the invention, an intermediate stand cooling is carried out in the reversing pass which is controlled over the length and the width of the strip in accordance with the temperature pattern. The intermediate stand cooling adjusts a constant rolling temperature, so that uniform, improved material properties are obtained over the entire length of the strip.

The arrangement according to the present invention for carrying out the above-described method includes a single-billet or multiple-billet casting plant with a soaking furnace arranged downstream of the casting plant and a cutting machine arranged between the casting plant and the soaking furnace. Downstream of the soaking furnace is arranged a reversible finishing rolling mill train which is followed by a coilbox. The coilbox may also be a winding furnace. After leaving the last rolling mill stand, the respective billet is wound in the coilbox. In this manner, the length of the building in which the arrangement is housed can be advantageously reduced and, most importantly, the temperature loss for the intermediate strip end or intermediate billet end can be kept very low.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the drawing:

The single FIGURE of the drawing is a schematic top view of the arrangement for carrying out the method of the present invention, wherein the coilbox is shown schematically in a side view.

DESCRIPTION OF THE PREFERRED EMBODIMENT

The arrangement illustrated in the drawing is a continuous casting plant which includes two casting machines 1 and 2. Downstream of each casting machine is arranged a soaking furnace 3 and 4, respectively, to which the billets 5 and 6, respectively, are directly introduced. Cutting machines 7, 8 for cutting the billets 5, 6 to a predetermined length are arranged between the casting machines 1, 2 and the soaking furnaces 3, 4. The soaking furnace 3 is followed by a roller table 9 which is used as a conveying roller table as well as a cooling roller table and which connects the soaking furnace 3 to a reversing finishing rolling mill train 10. Advantageously, this finishing rolling mill train 10 is a four-stand train, i.e., the train has four rolling mills F1, F2, F3, F4 which are arranged one behind the other.

Devices 11, 12 for descaling or cooling the rolling billets are arranged between the rolling mills F1, F2 and F3. The rolling mill F4 is followed by another descaling device 13 of the finishing rolling mill train 10 and a coilbox 14, in turn, follows the descaling device 13, wherein the coilbox 14 is shown in the drawing in a schematic side view, i.e., turned by 90° from the drawing plane.

The rolling mills F1, F2, F3, F4 of the finishing rolling mill train 10 are connected to drive motors 19, 20, 21, 22 through grooved roller gear units 15, 16, 17, 18. While a normal gear unit 23 is arranged between the grooved roller gear unit 18 and the drive motor 22, special changeover gear units 24 and 25 are advantageously provided between the grooved roller gear units 16 and 17 and the drive motors 20 and 21. The rolling mills F2 and F3 which carry the principal load of the finishing rolling mill train 10 are driven through these change-over gear units 24 and 25. The change-over gear units 24 and 25 make possible a substantially better utilization of the drive motors 20, 21, i.e. the drive motors 20, 21 can be operated at full load without having to be oversized. Thus, motors can be used for driving the rolling mills F2, F3 which can be substantially smaller than was the case in the past in conventional rolling mills for manufacturing hot-rolled steel strips from continuously cast initial materials.

In operation of the two-billet casting plant schematically illustrated in the drawing, the casting machines 1, 2 produce initial strips or strands 5, 6 having a thickness of more than 50 mm, preferably of 65 mm. After reaching the desired billet length, the billet 5 or 6 is cut by the respective cutting machine 7 or 8 and is then heated in the soaking furnace 3 or 4 to a temperature of 1100° to 1130° C.

The strand 5 is moved from the soaking furnace 3 directly onto the roller table 9. During this time, the reel with driver 30 required for the later winding of the finished rolled strip is not used. The billet 5 is then conveyed from the roller table 9 to the rolling mill or the reversible finishing rolling mill train 10.

The billet 6 discharged from the soaking furnace 4 is transported to roller table 9 which serves as a front mill table. The transport is effected in direction of arrow 27 by means of an enclosed transfer carriage 26 and by means of a transverse displacement unit, not shown in detail in the drawings. The front mill table simultaneously serves as a runout table. The billet 6 is then conveyed directly to the finishing rolling mill train 10 without being enclosed and without the use of an intermediate storage unit or holding furnace.

The billets 5 and 6 are most advantageously conveyed from the soaking furnaces 3 and 4 to the finishing rolling mill train 10 alternatingly and continuously. The increased thickness of the initial strip or the thickness of the billets 5, 6 effectively reduces the temperature loss or the temperature increase required in the finishing rolling mill train 10.

For example, in operation of the arrangement of the present invention, the rolling mill F1 does not perform a pass reduction during the first time the respective billet is passed through the rolling mill F1. Thus, rolling mill F1 only operates as a conveyor for the strip or the billet. The rolled billets are descaled in the devices 11, 12 arranged behind the rolling mill F1 and the rolling mill F2, respectively. A small reduction of the thickness of the billet, for example, approximately 25%, is effected in rolling mill F2 and, thus, the rolls of rolling mill F2 are subject to little wear. A greater reduction of the thickness of the billets is effected in rolling mills F3 and F4. The intermediate thickness of the billets must be selected in such a way that, after descaling in the descaling device 13, the billets can be coiled or wound without problems in the coilbox 14. The winding speed of the billets in the coil box 14 is relatively low, i.e., approximately 1.6 m/s at the head and 2.8 m/s at the end, depending on the thickness of the strip.

The drives of the rolling mill F2 and F3 are advantageously equipped with change-over gear units 24 and 25. In certain cases, rolling mill F1 is also equipped with a change-over gear unit. As a result, the drive motors 20 and 21 can be utilized in an optimum manner and the investment costs are reduced. When the billets are passed for the first time through the rolling mills F1, F2, F3, F4 of the finishing rolling mill train 10, high moments and low rolling speeds are necessary, while low moments and high rolling speeds are required in the reversing procedure.

Before the reversing pass of the billet can be initiated, the drives of the rolling mills must be decelerated, the gear transmissions of the rolling mills F2 and F3 must be reversed and the drives must again be accelerated. In addition, if rolls constructed as continuous variable crown or CVC rolls are used, the rolls must be shifted and the mechanical adjustments must be moved into the new positions. During this time, the billet is kept hot in coilbox 14. Only the outer billet winding is cooled more in the coilbox 14 than the other inner windings of the billet. However, this temperature drop of approximately 15° C. of the outer billet winding can be very easily reduced by a non-uniform increase of the speed in the reversing pass and/or by a cooling unit between the rolling mills controlled over the length of the billet or strip in accordance with the temperature pattern.

A change-over gear unit is not required at the rolling mill F4 because the rates of rotation of the rolls of the rolling mill F4 are about the same during the first passage of the billets and during the reversing procedure.

For carrying out the reversing procedure, the rolled strip or rolled billet must be rewound or unwound from the coilbox 14 in the conventional manner in the opposite direction indicated by arrow 28. In order to remove secondary scales, the billet must be descaled in the descaling device 13 prior to being introduced into the rolling mill F4. All rolling mills F4 to F1 utilized in the reversing procedure. The finished rolled billet strip is then cooled and wound onto a reel which is denoted in the drawing with reference numeral 30. The runout speed from the finishing rolling mill train 10 after the last pass is approximately 8 m/s for a finished strip having a thickness of 2 mm. However, the reduced production caused by the reversing procedure can be easily compensated by increased rolling speeds.

The invention is not limited to the embodiment illustrated in the drawing. For example, as may be required by an adjustment to a single-billet or multiple-billet casting plant, the finishing rolling mill train may also be a three-stand rolling mill train. Also, the strip may be reciprocated on the roller table in front of the finishing roller train in order to realize lower temperatures of the initial strip introduced if this is required for metallurgical reasons.

While a specific embodiment of the invention has been shown and described in detail to illustrate the application of the inventive principles, it will be understood that the invention may be embodied otherwise without departing from such principles.

We claim:

1. In a method for manufacturing hot-rolled steel strip from continuously cast initial material having a thickness of more than 50 mm in continuously successive work steps, including cutting the continuously cast initial material after solidifying into billets having a certain length, heating the billets in a soaking furnace to rolling temperature and introducing the billets to a finishing rolling mill train for rolling the billets into the desired size, wherein the improvement comprises introducing each billet after being heated into a finishing rolling mill train having a plurality of reversible rolling mill stands arranged one behind the other, rolling each billet in the finishing rolling mill train in a forward movement with a direct sequence of several rolling passes with relatively high moment and low rolling speed and in a reversing movement with a direct sequence of several rolling passes with relatively low moment and high rolling speed, and adjusting a ratio of rate of rotation between drive motors and work rolls of the rolling mill stands between the forward movement and the reversing movement by changing gear transmission of the rolling mill stands.

2. The method according to claim 1, wherein the initial material has a thickness of more than 65 mm.

3. The method according to claim 1, comprising descaling the roller material by means of a descaling unit arranged within the finishing rolling mill train, descaling being performed between successive rolling passes during the forward movement and/or the reversing movement.

4. In an arrangement for manufacturing hot-rolled steel strip from continuously cast initial material having a thickness of more than 50 mm in continuously successive work steps, including means for cutting the continuously cast initial material after solidifying into billets having a certain length, a soaking furnace for heating the billets to rolling temperature, and means for introducing the billets into a finishing rolling mill train for rolling the billets into the desired size, the improvement comprising a casting plant for producing at least one billet, a soaking furnace arranged downstream of the casting plant, a cutting machine arranged between the casting plant and the soaking furnace, a finishing rolling mill train arranged downstream of the soaking furnace, the finishing rolling mill train including a plurality of rolling mill stands arranged one behind the other, a coil box arranged downstream of the finishing rolling mill train wherein at least one of the finishing rolling mill stands is a principal load-applying stand, the at least one principal load-applying stand being connected to a change-over gear unit.

5. The arrangement according to claim 4, wherein the finishing rolling mill train comprises three stands.

6. The arrangement according to claim 4, wherein the finishing rolling mill train comprises four stands.

7. The arrangement according to claim 4, wherein the initial material has a thickness of more than 65 mm.

8. The arrangement according to claim 4, comprising the descaling unit arranged between the rolling mill stands.

9. The arrangement according to claim 4, comprising a descaling unit arranged between the last rolling mill stand and the coil box.

* * * * *